US005307663A

United States Patent [19]

Shore et al.

[11] Patent Number: 5,307,663

[45] Date of Patent: May 3, 1994

[54] MULTIPLE OUTLET FINISHING MILL

[75] Inventors: Terence M. Shore, Princeton; Joseph R. Lawendowski, Southbridge, both of Mass.

[73] Assignee: Morgan Construction Company, Worcester, Mass.

[21] Appl. No.: 3,130

[22] Filed: Jan. 12, 1993

[51] Int. Cl.[5] ..... B21B 1/18; B21B 39/18

[52] U.S. Cl. ..... 72/228; 72/231; 72/235

[58] Field of Search ..... 72/226, 227, 228, 238, 72/239, 231, 230, 234, 222, 235; 140/1, 2

[56] References Cited

U.S. PATENT DOCUMENTS

| | | | |
|---|---|---|---|
| 1,910,889 | 5/1933 | Fisk | 72/228 |
| 2,354,771 | 8/1944 | Peterson | 72/228 |
| 3,228,505 | 1/1966 | Leitner | 72/228 |
| 3,383,896 | 5/1968 | Blinn | 72/228 |
| 3,557,438 | 1/1971 | Sieger | 72/426 |
| 3,596,487 | 8/1971 | Forsberg | 72/228 |
| 5,144,828 | 9/1992 | Grotepass et al. | 72/239 |

*Primary Examiner*—Lowell A. Larson
*Assistant Examiner*—Thomas C. Schoeffler
*Attorney, Agent, or Firm*—Samuels, Gauthier & Stevens

[57] ABSTRACT

In a single strand rolling mill wherein a product is rolled in a twist-free manner through a succession of finishing stands before proceeding to a laying head, the finishing stands are grouped into at least first and second blocks arranged respectively along first and second non-aligned paths, with the laying head lying on the second path. Switches are employed to alternatively direct the product exiting from the first block either to the second path for continued rolling in the second block prior to being directed to the laying head, or along a third path bypassing the second block and leading directly to the laying head.

6 Claims, 1 Drawing Sheet

MULTIPLE OUTLET FINISHING MILL

BACKGROUND OF THE INVENTION

1. Field of the Invention

This invention relates to continuous hot rolling mills of the type employed to roll rods and the like, and is concerned in particular with an improved layout for the finishing section of such mills.

2. Description of the Prior Art

The finishing section of a rod mill lies between the intermediate section of the mill and a laying head which forms the finished product into loops for subsequent deposit on a cooling conveyor.

Typically, the finishing section includes a plurality of finishing stands mechanically coupled to a common drive and commonly referred to as a "finishing block". The finishing block and associated equipment, including cooling boxes, shears, pinch rolls, etc. are conventionally arranged along a common path leading to the laying head.

This arrangement imposes certain restrictions on the ease with which the mill operator can shift from one product size to another. Additional difficulties are encountered when attempting to roll the smaller sized products at lower temperature ranges.

The objective of the present invention is to provide a novel and improved layout for the finishing section of the mill, which increases the flexibility of the mill, both with regard to finish product sizes and finish rolling temperatures.

A companion objective of the present invention is the reduction in costly down time conventionally experienced when shifting from one product size to another.

SUMMARY OF THE INVENTION

These and other objects and advantages of the present invention are achieved by grouping the finishing stands into at least first and second blocks arranged respectively along first and second non-aligned paths. The laying head lies on the second path, and by means of switches and side loopers, the product exiting from the first block can either continue as a larger diameter finished product directly to the laying head along a third path bypassing the second block, or it can be redirected as a process section to the second path for additional rolling in the second block before continuing on to the laying head as a smaller diameter finished product.

Preferably, the product is delivered to the finishing section of the mill along an upstream path aligned with the second path, with the first and second paths being parallel, and with the third path extending angularly from the first path to the second path.

DETAILED DESCRIPTION OF THE INVENTION

Figure 1:
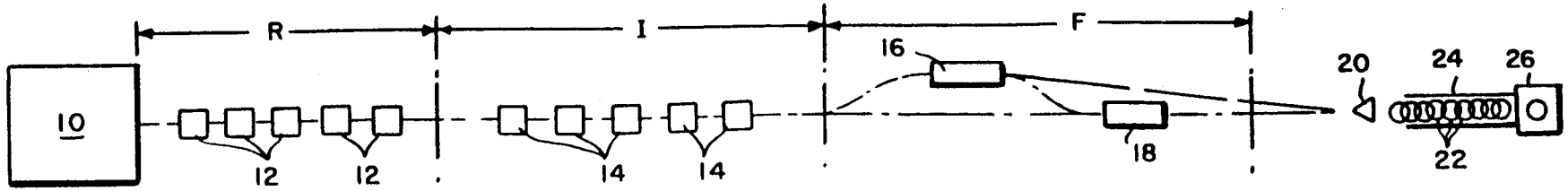
FIG. 1 is a diagrammatic layout of a rod rolling mill having a finishing section in accordance with the present invention.

Referring initially to FIG. 1, a rolling mill is shown comprising a billet reheating fumace 10, a roughing section "R" having a plurality of roughing stands 12, an intermediate section "I" with intermediate stands 14, and a finishing section "F" having first and second finishing blocks 16, 18. As herein employed, the term "finishing block" defines a series of mechanically interconnected roll stands driven by a common drive, with the work rolls arranged to roll the product in a twist-free manner. A typical example of a finishing block is disclosed in U.S. Pat. No. 4,537,055.

The finishing section F is located between the intermediate section I and a laying head 20 which forms the finished product into loops 22. The loops are received on a cooling conveyor 24 on which they are cooled before being reformed into coils at a coil forming station 26.

Figure 2:
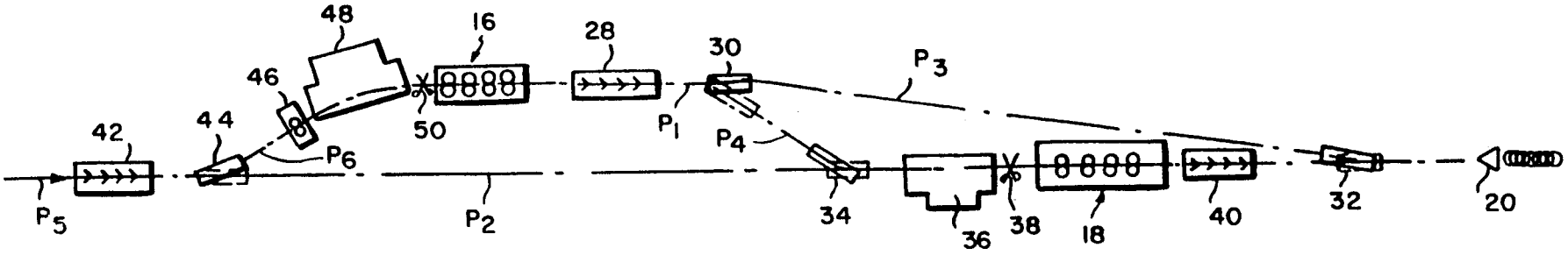
FIG. 2 is an enlarged and more detailed diagrammatic layout of the finishing section shown in FIG. 1.

With reference additionally to FIG. 2, it will be seen that the first and second finishing blocks 16, 18 are arranged respectively along parallel first and second paths $P_1$, $P_2$. The first block 16 is followed by a series of water boxes 28, and then by switch 30. Switch 30 is operative to alternatively direct the product exiting from the first block 16 either to a third path $P_3$ bypassing the second block 18 and rejoining the second path $P_2$ at a downstream switch, 32, or to a fourth path $P_4$ which rejoins the second path $P_2$ at a switch 34 preceding the second block 18. A side looper 36 and a shear 38 are located along the second path $P_2$ between the switch 34 and the second block 18, and a series of water boxes 40 is located downstream of the second block.

Product is received from the intermediate mill section I along an upstream path $P_5$ aligned with the second path $P_2$. Another series of water boxes 42 precedes a switch 44 located at the juncture of paths $P_2$, $P_5$. A branch path $P_6$ leads from the switch 44 to the first finishing block 16. A set of driven pinch rolls 46, a side looper 48 and a shear 50 are arranged along the path $P_6$ between the switch 44 and the first finishing block 16.

The layout of FIG. 2 can efficiently accommodate a wide range of product sizes and rolling and laying temperatures. For example, small diameter products can be rolled by setting the switches 44, 30, 34 and 32 to direct the product from path $P_5$ along paths $P_6$, $P_1$, $P_4$ and $P_2$ with successive rolling occurring in both finishing blocks 16 and 18. The side loopers 48 and 36 will operate to insure that product entering the respective downstream finishing blocks is not unduly tensioned, and the water boxes 42, 28 and 40 can be employed to control rolling and laying temperatures to suit various operating parameters.

Larger product sizes can be rolled by simply resetting the switches 30, 32 to direct the product exiting from the first finishing block 16 along path $P_3$, thus bypassing the second block 18. Operating personnel can take advantage of the production hiatus in the second block to perform various tasks, including for example changing worn guides and/or rolls, dummying selected stands to accommodate changes in product size, preparing the block to accept product directly from the intermediate mill section 1, etc. In the latter case, the switches 44, 34 can thereafter be adjusted to bypass the first finishing block 16, thereby enabling operating personnel to perform similar maintenance tasks while rolling continues through the second finishing block 18.

In all cases, the same laying head 20 can be employed to coil the product being rolled through the finishing mill.

We claim:

1. In a singled strand rolling mill wherein a product is rolled in a finishing mill in a twist-free manner through a succession of finishing stands before proceeding to a laying head, the improvement comprising:

said finishing stands being divided into at least first and second groups arranged respectively along first and second paths with said laying head lying on said second path;

first diverting means for alternatively directing the product exiting from said first group either to said second path for continued rolling in said second group prior to being directed to said laying head or along a third path bypassing said second group and leading directly to said laying head; and second diverting means for alternatively directing product being delivered to said finishing mill either to said first path for introduction into said first group, or to said second path for introduction into said second group.

2. The rolling mill of claim 1 wherein said first and second paths are parallel.

3. The rolling mill of claim 2 wherein said third path extends angularly from said first path to said laying head.

4. The rolling mill according to any one of the preceding claims wherein said diverting means each include side looping devices.

5. The rolling mill of claim 4 wherein said side looping devices are followed by shear mechanisms.

6. The rolling mill of claim 1 wherein the product is delivered to said second diverting means along a third path aligned with said second path.

* * * * *